US005351073A

United States Patent [19]

Kageyama et al.

[11] Patent Number: 5,351,073

[45] Date of Patent: Sep. 27, 1994

[54] INK JET CARTRIDGE WITH AN INK TANK HAVING AN INK OUTLET IN A SLOPED SURFACE

[75] Inventors: Tetsuto Kageyama, Koshigaya; Shigeru Yoshimura; Eiichi Motai, both of Yokohama, all of Japan

[73] Assignee: Canon Kabushiki Kaisha, Tokyo, Japan

[21] Appl. No.: 872,363

[22] Filed: Apr. 23, 1992

[30] Foreign Application Priority Data

Apr. 25, 1991 [JP] Japan ..... 3-095350

[51] Int. Cl.[5] ..... B41J 2/175

[52] U.S. Cl. ..... 347/87; 347/94

[58] Field of Search ..... 346/140 R, 75, 1.1

[56] References Cited

U.S. PATENT DOCUMENTS

| | | | |
|---|---|---|---|
| 4,313,124 | 1/1982 | Hara | 346/140 R |
| 4,345,262 | 8/1982 | Shirato et al. | 346/140 R |
| 4,404,573 | 9/1983 | Kocot et al. | 346/140 R |
| 4,459,600 | 7/1984 | Sato et al. | 346/140 R |
| 4,463,359 | 7/1984 | Ayata et al. | 346/1.1 |
| 4,471,364 | 9/1984 | Kocot | 346/140 R |
| 4,558,333 | 12/1985 | Sugitani et al. | 346/140 R |
| 4,571,599 | 2/1986 | Reznka et al. | 346/140 R |
| 4,723,129 | 2/1988 | Endo et al. | 346/1.1 |
| 4,740,796 | 4/1988 | Endo et al. | 346/1.1 |

FOREIGN PATENT DOCUMENTS

| | | |
|---|---|---|
| 59-123670 | 7/1984 | Japan . |
| 59-138461 | 8/1984 | Japan . |

*Primary Examiner*—Benjamin R. Fuller
*Assistant Examiner*—John Barlow
*Attorney, Agent, or Firm*—Fitzpatrick, Cella, Harper & Scinto

[57] ABSTRACT

A sloped surface is provided inside an ink tank of an exchangeable ink jet head cartridge arranged in a scan-type ink jet apparatus. An acceleration of the ink jet head cartridge scanned for recording and an inertia of ink are utilized to allow the ink to climb the slope, whereby the ink can be favorably supplied to a recording head.

14 Claims, 5 Drawing Sheets

INK JET CARTRIDGE WITH AN INK TANK HAVING AN INK OUTLET IN A SLOPED SURFACE

BACKGROUND OF THE INVENTION

1. Field of the Invention

The present invention relates to an ink jet cartridge having a recording head for recording by discharging ink from a discharging port integrated with a tank for storing ink which is supplied to the recording head, and an ink jet apparatus equipped with the cartridge.

2. Related Background Art

Recording means applicable to an ink jet apparatus may be mainly classified into a so-called serial-type head which scans a recording head in the direction perpendicular to a transporting direction of a recorded material and a so-called full line type head having discharging ports aligned within a width of a one-line portion of a recorded material which records by transporting the recorded material. The serial type head is further divided into a separate type having separately arranged recording head and ink tank for storing ink to be discharged, and a cartridge type which has a recording head and an ink tank integrated with each other so as to be exchangeably arranged in the ink jet apparatus.

Within a variety of these types of heads, the cartridge type is attracting attention as a preferable type of head suitable to a recording apparatus for personal use, since it can reduce initial cost, running cost, and the size and weight of the recording apparatus.

FIG. 6 shows an example of a typical structure of this type of head cartridge 20. In the example of FIG. 6, a porous absorber 21 is accommodated within an ink tank 21A in a compressed form and impregnated with ink.

On a lateral side of the ink tank 21 there is integrally mounted a recording head 22 having a discharging port 24 for discharging ink, and an ink supplying path 23 communicates the ink tank 21A with the recording head 22.

Supply of ink from the ink tank 21A to the recording head 22 is achieved by utilizing a pressure difference generated by pressing the ink supplying path 23 to the porous absorber 21 impregnated with ink. Specifically, this pressure difference allows ink to concentrate from the ink tank 21A to the supplying path 23, and the ink concentrated to that region is favorably introduced to the recording head 22 by utilizing a capillary action.

Although this type of ink jet head cartridge 20 achieves favorable ink discharge and provides a satisfactory recording quality, it further implies the following drawbacks to be improved which are caused by the characteristic of the ink tank 21A:

(1) A quantity of ink held by the porous absorber accommodated in the ink tank in a compressed form is approximately half of the volume of the ink tank;

(2) Since the ink tank cannot store a large quantity of ink, the ink jet head cartridge must be exchanged many times;

(3) The porous material is expensive;

(4) Since the porous material is used, as the quantity of ink in the ink tank is decreased, a negative pressure on the absorber side becomes larger, which impedes smooth supply of ink to the head. It is therefore difficult to use up the ink to the last drop;

(5) A further reduction in size of the cartridge is difficult. Specifically, if a smaller porous material is used, an ink storage quantity itself is also reduced; and (6) The size of the ink jet recording apparatus body cannot be further reduced due to the drawback (5).

SUMMARY OF THE INVENTION

The present invention has been proposed to solve the above-mentioned problems, and its object is to provide an ink jet head cartridge which is capable of ensuring a sufficient storage quantity of ink while its size can be reduced.

It is believed that a reduction in size and improvements in an ink filling efficiency and an ink using efficiency can be accomplished by an improved ink supplying mechanism realized by directly filling liquid ink in an ink tank in place of using an ink absorber and effectively utilizing a force to serially scan a head and a transportation of the ink by means of an inertia generated by the scanning force.

The present invention has been made on the basis of the above-mentioned view and provides an exchangeable ink jet cartridge for an ink jet apparatus comprising:

a recording head portion having a discharging port for discharging ink; and an ink tank portion for storing ink supplied to the recording head, wherein the ink tank portion includes a slope extending in the opposite direction with respect to the gravity direction toward the recording head connected to the ink tank, and an inlet port of an ink supplying path formed in a part of the slope for communicating the ink tank portion with the recording head portion.

The present invention also provides an exchangeable ink jet cartridge for an ink jet apparatus comprising:

a recording head portion having a discharging port for discharging ink; and an ink tank portion for storing ink supplied to the recording head, wherein the ink tank portion includes slopes upwardly extending from the side of the recording head portion connected to the ink tank portion and from the side opposite to the recording head portion to a substantially central portion of the ink tank portion, and an inlet port of an ink supplying path formed in a part of the slope for communicating the ink tank portion with the recording head portion.

The present invention further provides an ink jet apparatus for recording on a recorded medium by discharging ink on the recorded medium comprising:

an exchangeable ink jet cartridge for the ink jet apparatus; and a supporting member for supporting the ink jet cartridge mounted thereon, wherein the ink jet cartridge comprises a recording head portion having a discharging port for discharging ink, and an ink tank portion for storing ink supplied to the recording head portion, the ink tank portion including a slope extending in the opposite direction with respect to the gravity direction toward the recording head connected to the ink tank, an inlet port of an ink supplying path formed in a part of the slope for communicating the ink tank portion with the recording head portion, and an atmosphere communicating port for communicating the ink tank portion with the atmosphere, and the supporting member includes an engaging member which opens the atmosphere communicating port only when the ink jet cartridge is mounted on the supporting member.

The present invention also provides an ink jet apparatus for recording on a recorded medium by discharging ink on the recorded medium comprising:

an exchangeable ink jet cartridge for the ink jet apparatus; and a supporting member for supporting the ink jet cartridge mounted thereon, wherein the ink jet cartridge comprises a recording head portion having a discharging port for discharging ink, and an ink tank portion for storing ink supplied to the recording head portion, the ink tank portion including slopes upwardly extending from the side of the recording head portion connected to the ink tank portion and from the side opposite to the recording head portion to a substantially central portion of the ink tank portion, an inlet port of an ink supplying path formed in a part of the slope for communicating the ink tank portion with the recording head portion, and an atmosphere communicating port for communicating the ink tank portion with the atmosphere, and the supporting member includes an engaging member which opens the atmosphere communicating port only when the ink jet cartridge is mounted on the supporting member.

According to the present invention, a porous material in an ink tank can be removed or reduced so that the ink tank can store ink up to its storing capacity. Therefore, a larger quantity of ink can be stored in the same capacity of ink tank as compared with a structure in which a porous material is accommodated in an ink tank. Further, for storing a constant quantity of ink, the size of an ink tank can be reduced.

Since an inertia generated by the scan of a carriage can be utilized to introduce ink to a supplying path, the inner structure of the ink tank can be simplified, which results in reducing a cost.

It is further possible to reduce the size of the ink tank and accordingly the size of a printer body as well as to ensure stable supply of ink.

DESCRIPTION OF THE PREFERRED EMBODIMENTS

Embodiments of the present invention will hereinafter be described in detail with reference to the accompanying drawings.

Figure 1:
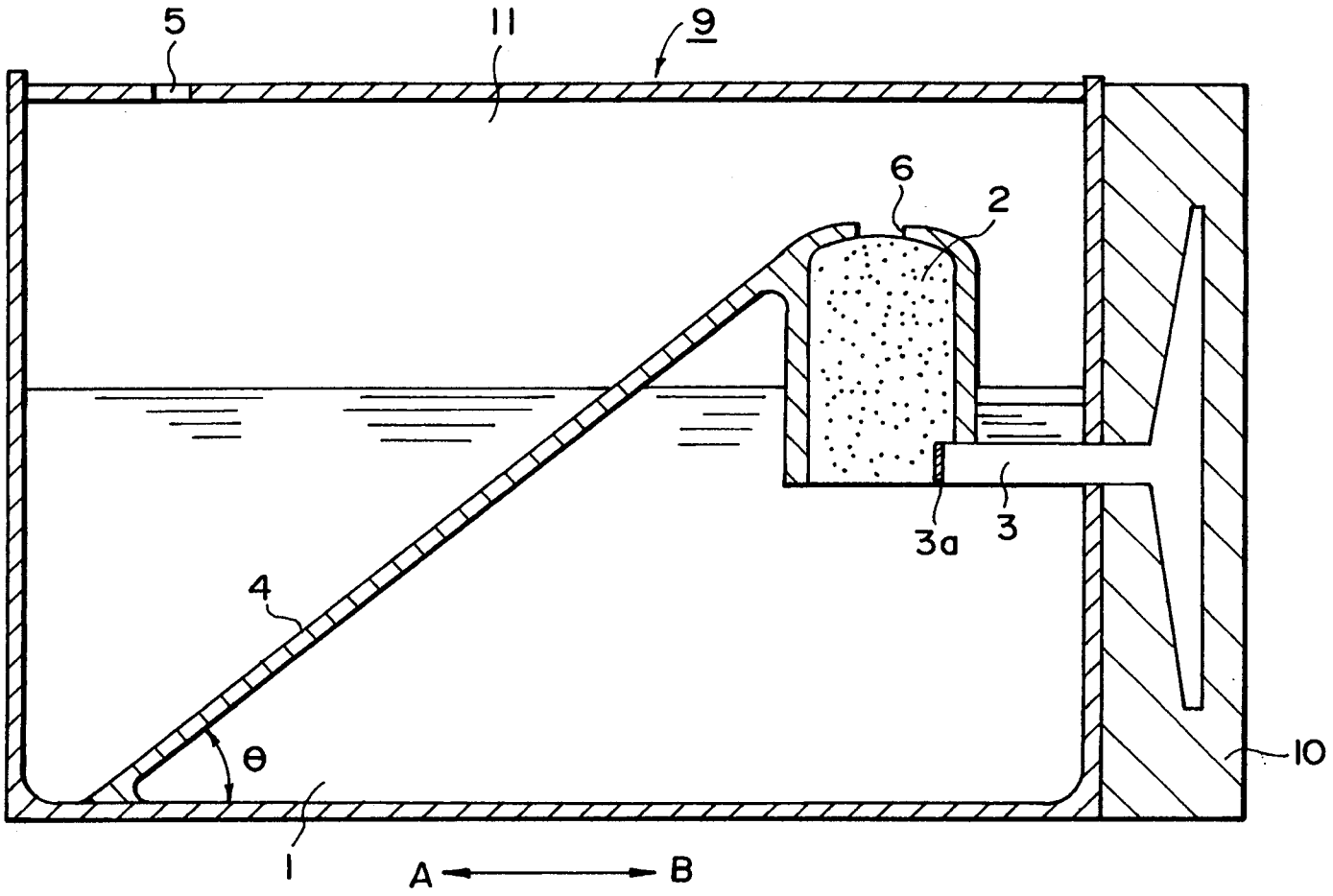
FIG. 1 is a schematic cross-sectional view showing an embodiment of the present invention.

FIG. 1 is a schematic cross-sectional view showing an outline of an ink jet head cartridge which is arranged in an ink jet printer, used for explaining a preferred embodiment of the present invention. In FIG. 1, reference numeral 1 designates ink which is stored in an ink tank 11 and discharged from a recording head; 2 a porous material packed in an ink supplying path for supplying the recording head with ink; 3 an ink supplying flow path, utilized to supply the recording head with the ink stored in the ink tank, which is provided with a filter 3*a* in a junction with the porous material 2; 4 an ink guiding slope formed in a supplying tank 11; 5 an atmosphere communicating port for opening the inside of the supplying tank to the atmosphere; 6 an ink inlet port for introducing ink climbing the slope 4 into the ink supplying flow path 3; and 10 a recording head which communicates with the ink tank through the ink supplying flow path 3.

Next, the operation of the ink jet head cartridge shown in FIG. 1 will hereinafter be explained.

This ink jet head cartridge is mounted on a carriage which moves for a scan between a recording area and an nonrecording area in a recording apparatus. Therefore, execution of a recording operation causes the ink jet head cartridge to move. In this event, ink stored in the ink tank 11 of the cartridge is agitated inside the tank 11 by the movement of the carriage.

The present invention positively utilizes an acceleration and an inertia generated by the movement of the carriage to supply the head 10 with ink.

Specifically explaining, when the carriage moves in the direction B shown in FIG. 1, the ink 1 in the ink tank 11 mainly moves toward the left of the tank (toward a base end of the slope 4). When the carriage stops moving in the direction B and immediately starts moving in the direction A, the ink 1 in the tank 11 receives an inertia and an acceleration generated by the turnaround of the carriage which causes the ink 1 to move toward the right of the tank 11. At this time, a majority of the ink moving toward the right climbs the slope 4. Since the port 6 is formed in the vicinity of the top of the slope 4, the ink 1 having climbed the slope 4 flows into the port 6. This port 6 serves as an ink inlet port for introducing the ink 1 to the ink supplying path 3 for supplying the recording head 10 with the ink 1. The ink 1 thus flowing through the ink inlet port 6 is absorbed in the porous material 2 packed in the ink supplying path 3 to form an ink supply enabled state. Incidentally, the present embodiment is adapted to generate a negative pressure on the ink tank side by this porous material 2 so as to balance with a meniscus of the discharging port of the recording head 10.

In the present embodiment, the relationship between an angle $\theta$ of the ink guiding slope 4 and an acceleration of the carriage is expressed by the following equation:

$$\alpha \geqq G \tan\theta \quad (1)$$

where $\alpha$ represents an acceleration of the carriage, G the acceleration of gravity and $\theta$ an angle of the ink guiding slope with respect to the bottom surface of the ink tank 11. By appropriately selecting $\alpha$ and $\theta$ to satisfy the equation (1), the ink 1 can climb the ink guiding slope 4 by the acceleration of the carriage generated when the carriage moves in the direction A shown in FIG. 1, is introduced through the ink inlet port 6 into the porous material 2, and is favorably supplied to the recording head 10 through the ink supplying flow path 2. Incidentally, if the angle $\theta$ is too steep, a large acceleration is necessary. Contrarily, if the angle $\theta$ is too gentle, the position of the ink inlet port 6 becomes lower, which results in decreasing the quantity of ink which is substantially stored in the tank. Thus, the angle $\theta$ is a factor which practically depends also on the shape of the cartridge. It is preferable that the slope 4 for supplying ink to the ink inlet port 6 extends in the tank to such a degree that its dimension occupies a half or more of the tank dimension. A slope dimension narrower than that will make it difficult to supply the ink 1 to the ink inlet port 6. A wider slope dimension than that may be preferable, however, a margin is necessary to allow the ink 1 in the tank 11 to sufficiently move therein.

The atmosphere communicating port 5 on the ink tank side of the ink jet head cartridge of the present embodiment is adapted to prevent the ink 1 stored in the tank 11 from leaking therethrough. For example, an atmosphere communicating path between the ink tank 11 and the outside can be shaped in a complicated form, or the port can be provided with a material which lets air pass therethrough but not a solution.

In the present embodiment, the ink supplying path 3 is put aside in the vicinity of the lateral side of the ink tank 11 on which the recording head 10 is connected. The provision of the ink supplying path 3 at this location can minimize the length of the ink supplying path for the recording head 10 as well as makes the angle of the slope 4 gentler, whereby the ink 1 can be supplied to the recording head 10 further favorably by utilizing the acceleration of the carriage.

Preferably, the ink inlet port 6 forms a wide opening. This is because if it is too narrow, an ink membrane may be formed over the opening due to surface tension, which results in hindering ink from being supplied to the ink supplying path 3. Alternatively, the absorber 2 may be protruded in the port 6 in order to prevent the formation of such an ink membrane.

The above-mentioned structure allows effective utilization of an acceleration of the carriage and an inertia of ink, thereby making it possible to supply the recording head 10 with the ink 1 in the ink tank 11 to the last drop.

Figure 2:
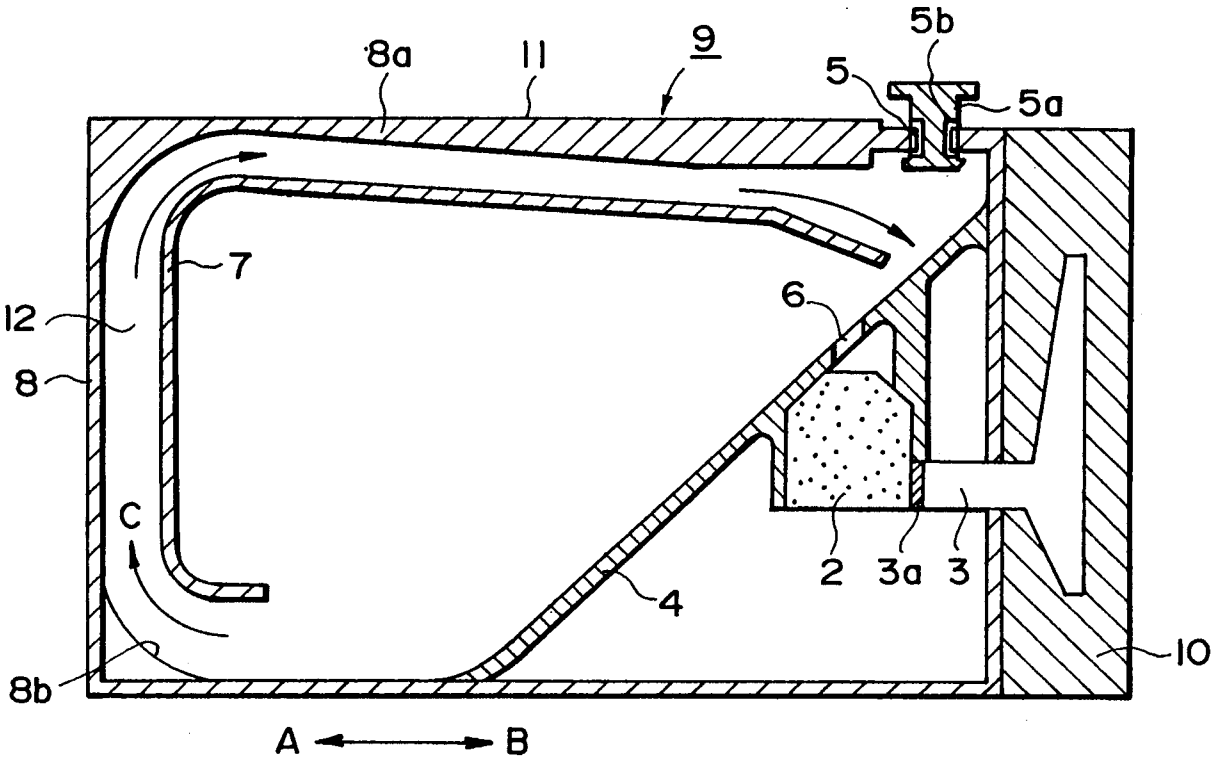
FIG. 2 is a schematic cross-sectional view showing another embodiment of the present invention.

FIG. 2 shows another embodiment of an ink jet head cartridge to which the present invention is applied. In this embodiment, the ink jet head cartridge is provided inside an ink tank with a loop-like portion for effectively utilizing an inertia of ink, in addition to the slope of the foregoing embodiment.

Specifically, as shown in FIG. 2, as a structure which enables ink in an ink tank 11 to be favorably supplied to an ink supplying path 3 by a movement of a carriage in either of scanning directions (the directions A and B), the ink tank 11 is provided with a guiding member 7 extending from a lower corner portion of a side wall 8 opposite to that on which the ink supplying path 3 is arranged to the far side of an upper wall 8*a* substantially along the walls 8 and 8*a*.

The above-mentioned guiding member 7 forms a loop-like portion 12 from the left bottom portion 8*b* to the vicinity of an ink supplying port 6 in the ink tank 11. Then, an acceleration of the carriage generated by scanning the cartridge mounted on the carriage in the direction A is utilized so that ink climbs a slope 4 and enters the ink supplying port 6. Also, when the carriage is scanned in the direction B, the ink in the ink tank 11 moves as indicated by arrows C along the loop-like portion 12 by utilizing an inertia to reach above the ink supply port 6, and then is guided by the upwardly extending slope 4 to flow into the ink supplying port 6, whereby an ink supplying state is achieved. This structure ensures that the ink in the ink tank 11 is supplied to the recording head 10 to the last drop irrespective of the moving or scanning direction of the cartridge.

Incidentally, in the present embodiment, an atmosphere communicating port 5 has a cap 5*a* for opening and closing the port 5. This cap 5*a* is formed with an atmosphere communicating path 5*b* such that the ink tank 11 is open to the atmosphere by raising the cap 5*a* and closed by lowering the same. By thus opening and closing the atmosphere communicating port 5 by the cap 5*a*, adverse influences due to ink leakage are prevented by closing the port 5 during the distribution of the cartridge, as well as favorably supplying ink to the recording head by easily making an atmosphere communicating state when the cartridge is used. Particularly, if a carriage is provided with a cap engaging member which lifts up the cap 5*a* to provide the atmosphere communicating state when the ink jet head cartridge is mounted on the carriage, reliable mounting of the cartridge on the carriage and communication with the atmosphere are simultaneously carried out without manipulation of the operator. Specifically, by providing the carriage with, for example, a pawl member for engaging with the atmosphere communicating cap 5*a* of the cartridge, the atmosphere communicating state of the atmosphere communicating port 5 can be readily achieved in response to the mounting of the cartridge.

Figure 3:
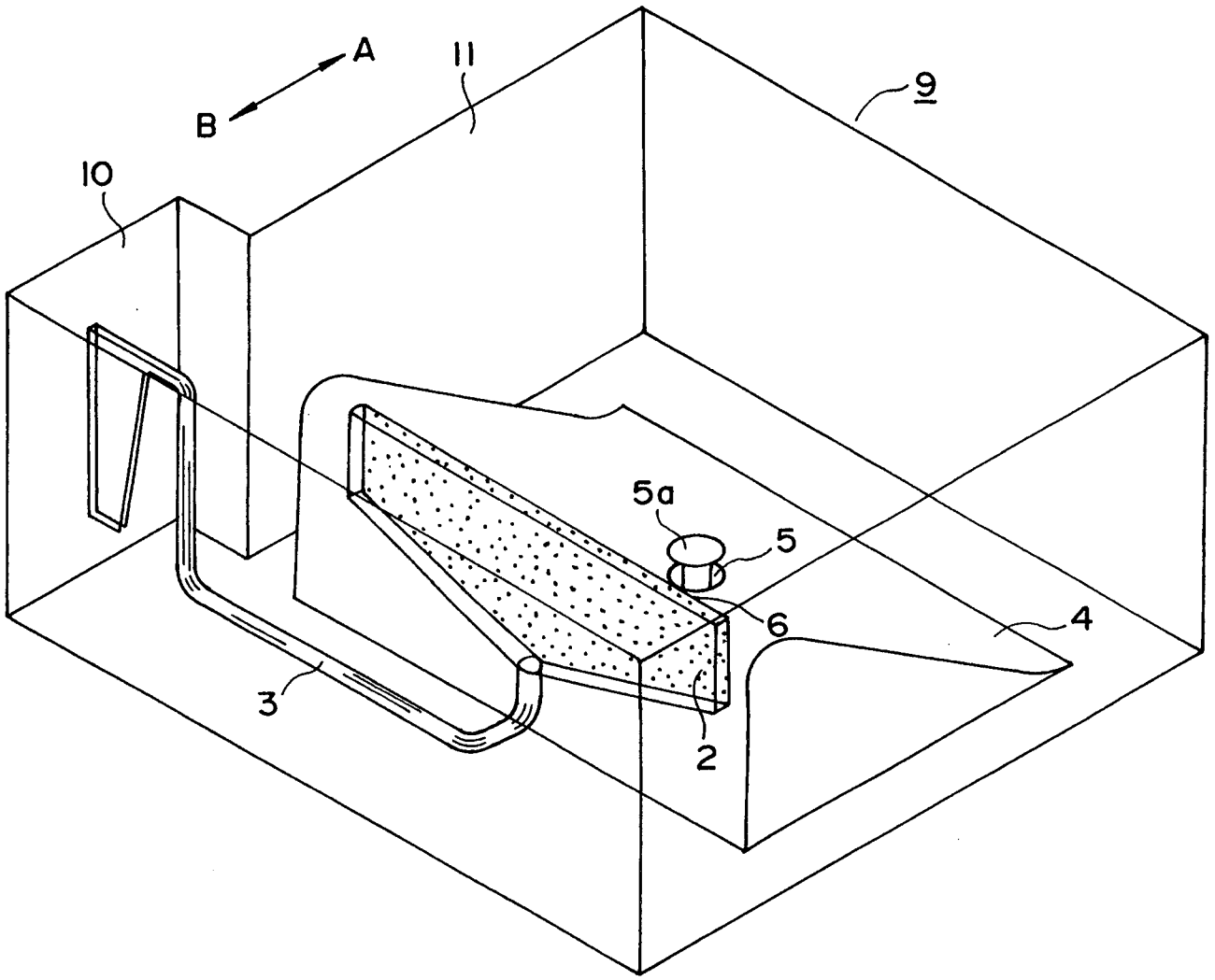
FIG. 3 is a partially perspective view showing an example of an ink jet head cartridge.

An ink supplying path 3 from the ink supplying port 6 to the recording head 10, apart from a direct coupling structure as shown in FIGS. 1 and 2, may form a relatively long path as shown in FIG. 3, whereby an ink path resistance is made larger to produce a negative pressure condition. Alternatively, such a negative pressure condition may be produced by restricting an air flow from the atmosphere communicating port 5.

Figure 4:
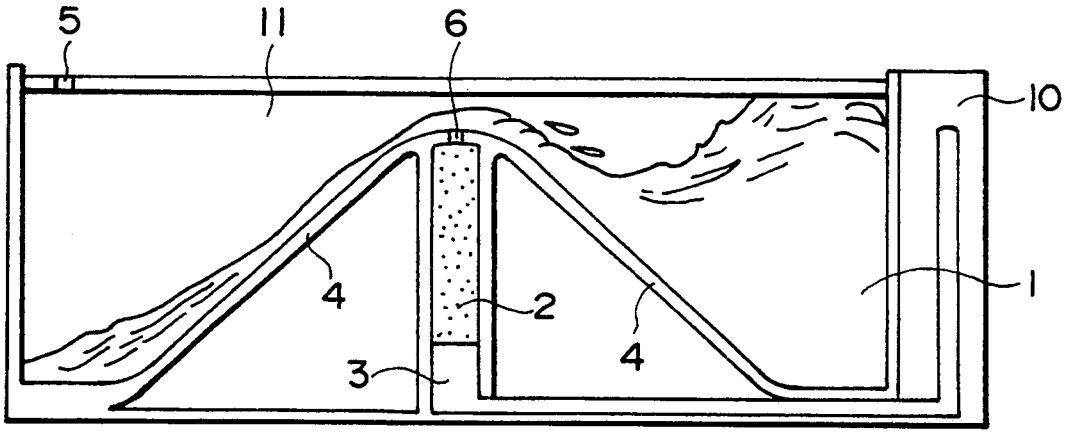
FIG. 4 is a schematic cross-sectional view showing a further embodiment of the present invention.
Figure 6:
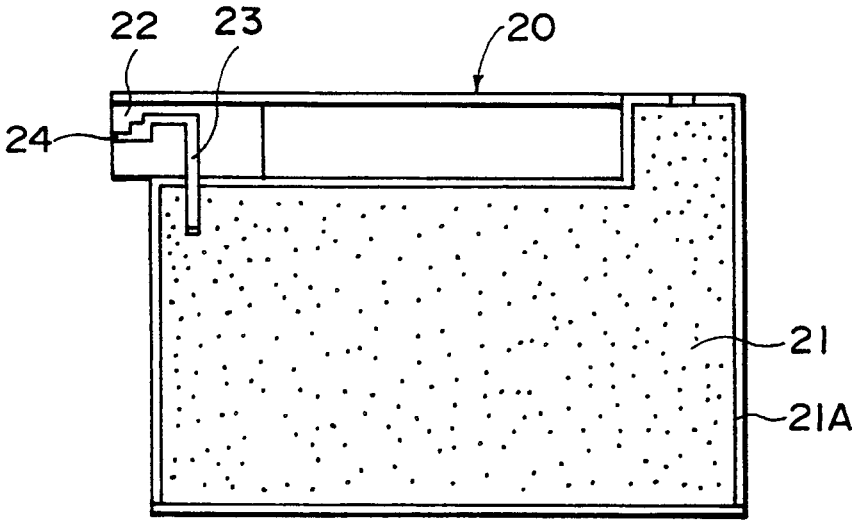
FIG. 6 is a schematic cross-sectional view showing an outline of a conventional ink jet head cartridge.

FIG. 4 shows a further embodiment of the present invention.

In the present embodiment, a porous material 2 and an ink supplying path 3 are located in a central portion of an ink supplying tank 11, so that accelerations in two directions generated by a carriage of an ink jet printer, not shown, moving in either of the left and right directions can be effectively utilized to enable ink in the ink tank 11 to be favorably supplied from an ink inlet port to an ink path and to constantly immerse the porous material 2 with the ink, whereby the ink can be extremely satisfactorily discharged from a recording head, not shown. This structure is provided for a bidirectional recording mechanism used for a high speed printer, wherein timings of ink supply can be doubled as compared with the structures shown in FIGS. 1, 2 and 3, thereby achieving a stable ink supply.

Figure 5:
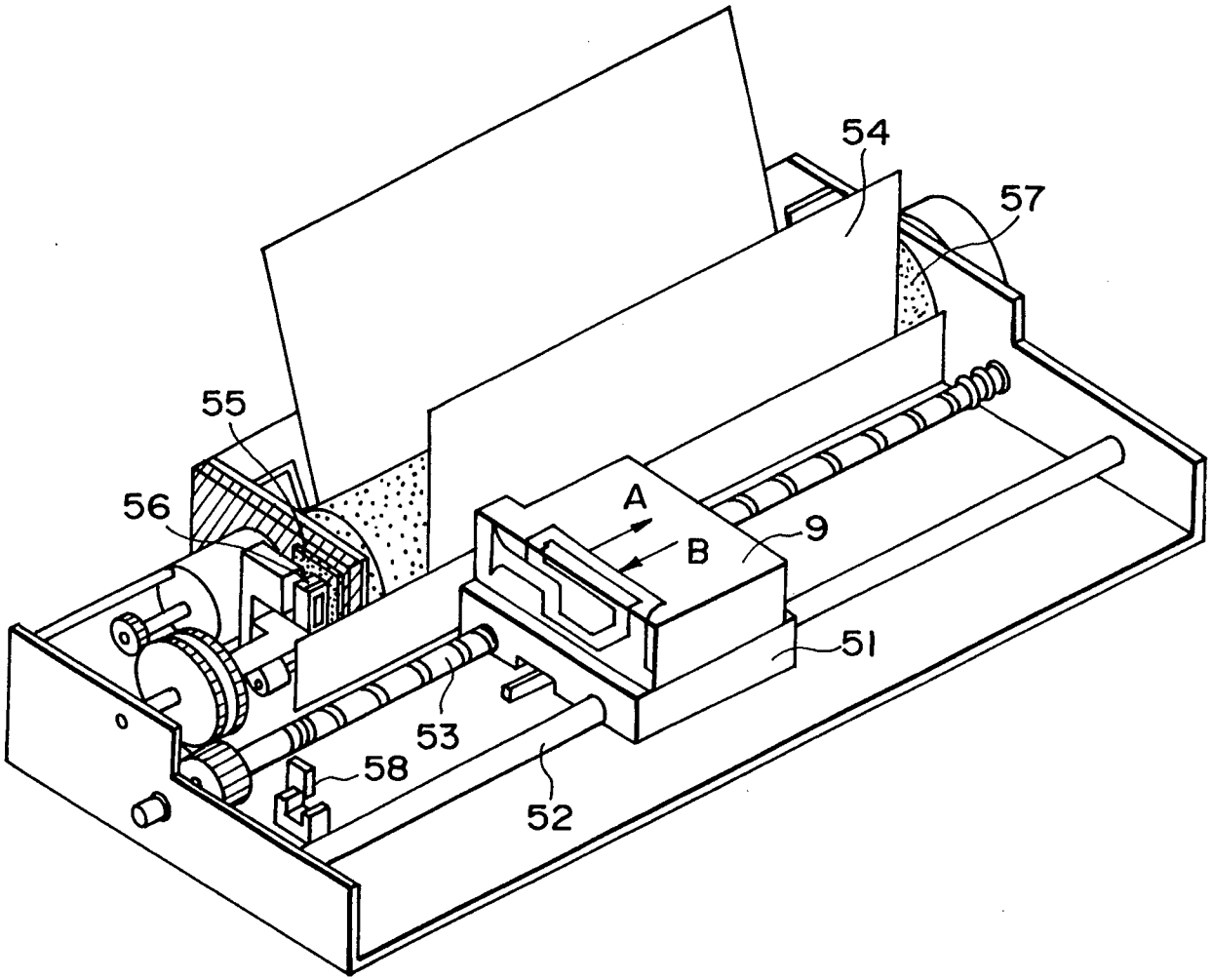
FIG. 5 is a perspective view showing that the further embodiment of the present invention is arranged in a printer body.

FIG. 5 schematically shows an ink jet printer in which the ink jet head cartridge embodying the present invention is mounted on a carriage.

A carriage 51 moves in directions A and B along a carriage guide 53 by a lead screw 53. In an ink jet head cartridge 9 mounted on the carriage 51, therefore, ink waves due to accelerations generated by the movement of the carriage in the directions A and B, and this state is utilized to favorably supply the ink to the ink supplying path with the help of the slope and so on formed inside the ink tank.

By inputting a predetermined recording signal, the carriage 51 is scanned while a recorded member 54 supported by a platen is transported, that is, a relative movement is carried out to achieve a desired recording.

Incidentally, in a non-recording region out of a recording region for the recorded member 54, the ink jet apparatus is equipped with a carriage position detecting means 58, a wiping member 55 for cleaning a discharging port forming face of the recording head 10, and a capping member 56 for covering the discharging port forming face.

The cartridges 9 shown in FIGS. 1, 2, 3 and 5 are all constructed such that ink is supplied to the recording head by scanning the carriage in the direction A. In other words, ink is supplied by utilizing a force generated by a movement of the carriage when it is scanned for recording. Such a mechanism is adapted to prevent ink from being used up during recording and defective discharge of ink from occurring by simultaneously consuming ink for recording and supplying ink to the recording head.

However, it goes without saying that, contrary to the above-mentioned structure, ink may be supplied to the recording head while the carriage returns after a scan for recording a line has been completed. Such a structure of supplying ink to the recording head during a carriage returning period is free from fluctuations of an ink supplying pressure which is possibly caused by supplying ink during recording, whereby a stable state can be maintained in the ink supplying path.

The cartridges 9 shown in the foregoing embodiments must be exchanged when ink in the tank is used up. Otherwise, printing or image formation is not available on a recorded member. To prevent this problem, it is preferable that a means for detecting a remaining quantity of ink in the ink tank is provided. A variety of conventionally known structures of such a means for detecting a remaining quantity of ink are applicable to the present invention, for example, a structure which has a pair of electrodes and measures a change in resistance of the electrodes, and a structure which counts a frequency of ink discharge, converts it to a discharged ink quantity, derives an ink remaining quantity by comparing the discharged ink quantity with an initial ink quantity, and warns the user of a shortage of ink.

An ink remaining quantity is detected by these structures, and when a no-ink remaining state is found, the user is warned and prompted to exchange the cartridge.

When the user does not exchange the used-up cartridge after this warning, even if the user is going to execute recording, a recording signal is held in a memory and the carriage is locked to inhibit recording, thereby making it possible to achieve further reliable recording.

The present invention is suitable to an ink jet recording system, and particularly, to a recording head or recording apparatus which is equipped with a means (for example, an electric-thermal convertor, a laser beam or the like) for generating thermal energy as energy utilized to discharge ink to generate a change in an ink state by the thermal energy. This is because such a recording system can achieve high density and high resolution recording.

Typical structure and principle of the abovementioned system preferably employs the basic principles disclosed, for example, in U.S. Pat. Nos. 4,723,129 and 4,740,796. This system is applicable to either of so-called on-demand type and continuous type. Particularly, this system is effective in the on-demand type since the on-demand type is adapted to apply at least one driving signal for causing a rapid temperature rise corresponding to recording information and exceeding the nucleate boiling to an electric-thermal convertor arranged in correspondence with a sheet and a liquid path in which liquid (ink) is held so as to generate thermal energy in the electric-thermal convertor, cause film boiling to occur on a heat acting face of a recording heat, and consequently form bubbles in the liquid (ink) which corresponds to the driving signal one by one. The liquid (ink) is discharged from a discharging port by the growth and contraction of bubbles to form at least one drop. It is preferable that a pulse signal is used as the driving signal because the growth and contraction of bubbles are immediately and properly controlled thereby so that an ink discharge mechanism, particularly excellent in a response characteristic, is achieved. As this pulse-shaped driving signal, those described in the specifications of U.S. Pat. Nos. 4,463,359 and 4,345,262 are suitable. Further, if conditions described in the specification of U.S. Pat. No. 4,313,124 concerning a temperature rising ratio on the heat acting face are employed, further excellent recording can be achieved.

It should be noted that the present invention also includes such recording head structures as those using inventions described in the specifications of U.S. Pat. Nos. 4,558,333 and 4,459,600 which disclose a structure in which a heat acting portion is arranged in a bent region, in addition to a combined structure (a straight flow path or a perpendicular flow path) formed of a discharging port, a liquid path and an electric-thermal convertor as disclosed in the above-mentioned respective specifications. Additionally, the present invention is effective also to structures based on Japanese Laid-open Patent Application No. 59-123670 which discloses a structure where common slits serve as discharging portions of a plurality of electric-thermal convertors and Japanese Laid-open Patent Application No. 59-138461 which discloses a structure where an opening for absorbing pressure wave of thermal energy is arranged corresponding to a discharging portion. This is because the present invention ensures efficient recording irrespective of the shape of a recording head.

Also, addition of a recovering means for a recording head, a preparatory supporting means and so on is preferable since the effect of the present invention can be stabilized by these means. Specifically, these means may be a capping means for a recording head, a cleaning means, a pressurizing or compressing means, a preparatory heating means comprising an electric-thermal convertor, a heating element other than this or a combination of these two. It is also effective for stable recording to perform a preparatory discharging mode for performing other discharge than that for recording.

Further, as to the kind and number of mounted recording heads, the present invention is applicable to a cartridge which is provided with a plurality of recording heads corresponding to a plurality of kinds of ink which are different in recording color and concentration, other than a cartridge which is provided with a single head corresponding to single color ink. Specifically, the present invention is highly effective to a recording apparatus having not only a recording mode in a main color such as black but also at least one of a plural color mode using different colors or a full color mode by mixing different colors, by the use of either an integral recording head or a combination of plural recording heads.

Further additionally, an ink jet recording apparatus to which the present invention is applied may be, other than that used as an image outputting terminal for an information processing machine such as a computer, a copy machine combined with a reader or the like, a facsimile apparatus having transmitting and receiving functions, and so on.

As described above, according to the present invention, a cartridge having an extremely high volume efficiency can be provided which is capable of supplying liquid ink stored in an ink tank to the last drop only by utilizing an acceleration generated by a carriage moving in the left and right directions for printing and an inertia of ink. Since no additional ink supplying device is necessary, the capacity of a compact ink tank in the form of a cartridge can be increased, and the structure is simple, a cost reduction is achieved. Further, reductions in size of the cartridge and printing apparatus are simultaneously carried out while a stable supply of ink is ensured.

What is claimed is:

1. An exchangeable ink jet cartridge for mounting on a scanning carriage of an ink jet apparatus comprising a recording head portion having a discharging port for discharging ink, wherein said cartridge includes:

an ink tank portion having a sloped surface inclined at a predetermined angle to a scanning direction of said carriage, said sloped surface having an opening section communicating with an ink supply path for supplying ink from said ink tank portion to said recording head portion; and a negative pressure generating member provided in said ink supply path.

2. An ink jet cartridge according to claim 1, wherein an inertia generated by reciprocal scanning movement of said carriage is utilized to produce a flow of ink rising said sloped surface.

3. An ink jet cartridge according to claim 2, wherein said flow of ink rising said sloped surface is generated when said carriage is scanned for performing recording with ink discharged from said recording head portion.

4. An ink jet cartridge according to claim 2, wherein said flow of ink rising said sloped surface is generated when said carriage is scanned for returning to a start recording position after having completed one recording scan.

5. An ink jet cartridge according to claim 2, wherein the relationship between an angle of said sloped surface and a scanning acceleration of said carriage satisfies the following equation:

$$\alpha \geqq G \tan \theta$$

where $\alpha$ represents a scanning acceleration, $\theta$ an angle of said sloped surface, and G the acceleration of gravity.

6. An ink jet cartridge according to claim 1, wherein said recording head portion has an electric-thermal convertor for generating thermal energy which is utilized for discharging ink.

7. An exchangeable ink jet cartridge for mounting on a scanning carriage of an ink jet apparatus comprising a recording head portion having a discharging port for discharging ink, wherein said cartridge includes:

an ink tank portion having a sloped surface with two surfaces inclined at predetermined angles to a scanning direction of said carriage and meeting at an apex, said sloped surface having an opening section at said apex communicating with an ink supply path for supplying ink from said ink tank portion to said recording head portion; and a negative pressure generating member provided in said ink supply path.

8. An ink jet cartridge according to claim 7, wherein an inertia generated by reciprocal scanning movement of said carriage is utilized to produce a flow of ink rising said sloped surface.

9. An ink jet cartridge according to claim 8, wherein said flow of ink rising said sloped surface is generated when said carriage is scanned for performing recording with ink discharged from said recording head portion and when said carriage is scanned for returning to a start recording position after the scan for one recording is terminated.

10. An ink jet cartridge according to claim 8, wherein the relationship between an angle of said slope and a scanning acceleration of said carriage satisfies the following equation:

$$\alpha \geqq G \tan \theta$$

where $\alpha$ represents a scanning acceleration, $\theta$ an angle of said sloped surface, and G the acceleration of gravity.

11. An ink jet cartridge according to claim 7, wherein said recording head portion has an electric-thermal convertor for generating thermal energy which is utilized for discharging ink.

12. An ink jet recording apparatus comprising:

a recording head portion having a discharging port for discharging ink;

an exchangeable ink jet cartridge for mounting on a scanning carriage of said ink jet apparatus, said cartridge including an ink tank portion having a sloped surface inclined at a predetermined angle to a scanning direction of said carriage, said sloped surface having an opening section communicating with an ink supply path for supplying ink from said ink tank portion to said recording head portion, a negative pressure generating member provided in said ink supply path, and an atmosphere communicating port for communicating said ink tank portion with the atmosphere; and an engaging portion for opening said atmosphere communicating port only when said ink jet cartridge is mounted on said scanning carriage.

13. An ink jet recording apparatus comprising:

a recording head portion having a discharging port for discharging ink;

an exchangeable ink jet cartridge for mounting on a scanning carriage of said ink jet apparatus, said cartridge including an ink tank portion having a sloped surface with two surfaces inclined at predetermined angles to a scanning direction of said carriage and meeting at an apex, said sloped surface having an opening section at said apex communicating with an ink supply path for supplying ink from said ink tank portion to said recording head portion, a negative pressure generating member provided in said ink supply path, and an atmosphere communicating port for communicating said ink tank portion with the atmosphere; and an engaging portion for opening said atmosphere communicating port only when said ink jet cartridge is mounted on said scanning cartridge.

14. An ink jet cartridge according to claim 1, wherein said ink tank portion includes a flow path along an inner wall of said ink tank portion for connecting a lower portion of said sloped surface and a vicinity of said opening section.

* * * * *

UNITED STATES PATENT AND TRADEMARK OFFICE

CERTIFICATE OF CORRECTION

PATENT NO. : 5,351,073

DATED : September 27, 1994

INVENTOR(S) : TETSUTO KAGEYAMA, ET AL.

It is certified that error appears in the above-identified patent and that said Letters Patent is hereby corrected as shown below:

ON TITLE PAGE

In [56] References Cited, under U.S. PATENT DOCUMENTS: "Reznka et al." should read --Rezanka et al.--.

COLUMN 4

Line 19, "an" should read --a--.

COLUMN 6

Line 56, "guide 53" should read --guide 52--.

COLUMN 10

Lines 25-42, Claim 12 should read: --An ink jet cartridge according to claim 1, further comprising an atmosphere communicating port for communicating said ink tank portion with the atmosphere.--.

UNITED STATES PATENT AND TRADEMARK OFFICE

CERTIFICATE OF CORRECTION

PATENT NO. : 5,351,073

DATED : September 27, 1994

INVENTOR(S) : TETSUTO KAGEYAMA, ET AL.

It is certified that error appears in the above-identified patent and that said Letters Patent is hereby corrected as shown below:

COLUMN 10

Lines 43-61, Claim 13 should read: --An ink jet cartridge according to claim 12, wherein said atmosphere communicating port is moveable to be opened and closed by a supporting member having an engaging member which opens said atmosphere communicating port only when said ink jet cartridge is mounted.--.

Signed and Sealed this

Twenty-eight Day of February, 1995

*Attest:*

Bruce Lehman

BRUCE LEHMAN

*Attesting Officer*

*Commissioner of Patents and Trademarks*